US005727531A

United States Patent [19]

Osanai

[11] Patent Number: 5,727,531

[45] Date of Patent: Mar. 17, 1998

[54] APPARATUS FOR PROCESSING EVAPORATED FUEL

[75] Inventor: Akinori Osanai, Susono, Japan

[73] Assignee: Toyota Jidosha Kabushiki Kaisha, Toyoya, Japan

[21] Appl. No.: 708,711

[22] Filed: Sep. 5, 1996

[30] Foreign Application Priority Data

Sep. 8, 1995 [JP] Japan ..... 7-231315

[51] Int. Cl.[6] ..... F02M 25/07

[52] U.S. Cl. ..... 123/520; 123/306

[58] Field of Search ..... 123/516, 518, 123/519, 520, 306

[56] References Cited

U.S. PATENT DOCUMENTS

| | | | |
|---|---|---|---|
| 5,103,794 | 4/1992 | Shiraishi | 123/516 |
| 5,174,265 | 12/1992 | Sekine | 123/516 |
| 5,375,579 | 12/1994 | Mukai | 123/516 |

FOREIGN PATENT DOCUMENTS

| | | |
|---|---|---|
| U-61-36142 | 3/1986 | Japan . |
| U-61-36165 | 3/1986 | Japan . |
| A-4-124450 | 4/1992 | Japan . |
| A-4-237860 | 8/1992 | Japan . |
| A-7-158518 | 6/1995 | Japan . |

*Primary Examiner*—Thomas N. Moulis
*Attorney, Agent, or Firm*—Oliff & Berridge, PLC

[57] ABSTRACT

An apparatus for processing evaporated fuel produced in a fuel tank for a multicylinder engine evenly distributes purged fuel to each cylinder of the engine.

The apparatus has a canister 25 for adsorbing the evaporated fuel and a purge pipe 26 for connecting the canister to an intake duct and purging the adsorbed fuel into the intake duct. The purge pipe 26 has purge ports 1 and 2 that are open in the intake duct at different positions involving different velocities of intake air. The purge pipe 26 may have means for adjusting a flow time of purged fuel passing through the purge pipe. The purge ports may be arranged to produce a swirl of purged fuel in the intake air.

6 Claims, 4 Drawing Sheets

APPARATUS FOR PROCESSING EVAPORATED FUEL

BACKGROUND OF THE INVENTION

1. Field of the Invention

The present invention relates to an apparatus for processing evaporated fuel produced in a fuel tank for an internal combustion engine, and particularly to that of a multicylinder engine, for intermittently purging evaporated fuel from a canister evenly into cylinders during the operation of the engine.

2. Description of the Related Art

An apparatus for processing evaporated fuel produced in a fuel tank of an internal combustion engine employs a canister, containing an adsorbent such as activated carbon, to adsorb and accumulate the evaporated fuel. The canister is connected to an intake duct of the engine through a purge pipe in which a purge control valve is arranged. The purge control valve is intermittently opened and closed during the operation of the engine, to pass outside air through the adsorbent so that the air may vaporize and purge the adsorbed fuel from the canister into the intake duct.

The purged fuel in the intake duct is mixed with intake air which has been introduced into the intake duct through an air cleaner and a throttle valve. The mixture of purged fuel and air is mixed with fuel injected from a fuel injector, and the mixture of air and fuel is drawn into a cylinder of the engine. If the canister accumulates a large quantity of evaporated fuel, the fuel will be purged in a liquid or droplet state into the intake duct. If the velocity of intake air in the intake duct is low at this time, the purged fuel will not be sufficiently dispersed in the intake air and will adhere to the wall of the intake duct. This results in supplying an insufficient quantity of fuel into the cylinder, to change the air-fuel ratio, to deteriorate the operating conditions of the engine, and to emit unburned fuel.

Japanese Unexamined Patent Publication No. 4-237860 discloses an apparatus for processing evaporated fuel. The apparatus has a canister, a first purge port, and a second purge port. When a throttle valve in an intake duct is substantially closed, the first purge port is open to the intake duct on the upstream side of the throttle valve, and the second purge port is open to a narrow part of a venturi of the intake duct on the downstream side of the throttle valve. The first and second purge ports and canister communicate with one another. The narrow part of the venturi increases the velocity of an air flow, so that, even if the velocity of intake air is low, purged fuel from the second purge port is sufficiently dispersed, and a required quantity of fuel is surely supplied to each cylinder.

When the prior art is applied to a multicylinder engine, purged fuel from the second purge port may mostly flow into a specific cylinder instead of evenly flowing into each cylinder. This will happen when the purged fuel is mixed with a fast air flow, or when the duty cycle of the purge control valve is synchronized with the revolution speed of the engine. The uneven supply of fuel to the cylinders fluctuates combustion from cylinder to cylinder, destabilizes the torque of the engine, deteriorates drivability, and produces unburned fuel.

SUMMARY OF THE INVENTION

An object of the present invention is to provide an apparatus for processing evaporated fuel produced in a fuel tank of a multicylinder engine, capable of evenly distributing purged fuel to each cylinder, equalizing the combustion torque of each cylinder, improving drivability, and reducing an emission of unburned fuel.

In order to accomplish the object, a first aspect of the present invention provides an apparatus for processing evaporated fuel produced in a fuel tank for an internal combustion engine, having a canister for adsorbing the evaporated fuel and a purge passage for connecting the canister to an intake duct and purging the adsorbed fuel into the intake duct.

According to the first aspect, the purge passage has purge ports that are open in the intake duct at different positions involving different velocities of intake air.

The purge ports have openings on the same sectional plane of the intake duct and consist of a first purge port that is open to fast intake air in the intake duct and a second purge port that is open to slow intake air in the intake duct.

A second aspect of the present invention provides an apparatus for processing evaporated fuel produced in a fuel tank for an internal combustion engine, having a canister for adsorbing the evaporated fuel and a purge passage for connecting the canister to an intake duct and purging the adsorbed fuel into the intake duct.

According to the second aspect, the purge passage has branches and means for providing different flow times to purged fuel passing through the branches.

The means for providing different flow times may be a tank arranged in the purge passage.

A third aspect of the present invention provides an apparatus for processing evaporated fuel produced in a fuel tank for an internal combustion engine, having a canister for adsorbing the evaporated fuel and a purge passage for connecting the canister to an intake duct and purging the adsorbed fuel into the intake duct.

According to the third aspect, the purge passage has a purge port whose opening is twisted with respect to a flow of intake air in the intake duct.

The purge port of the third aspect may have a restrictor for restricting a flow of purged fuel.

DESCRIPTION OF THE PREFERRED EMBODIMENTS

Figure 1:
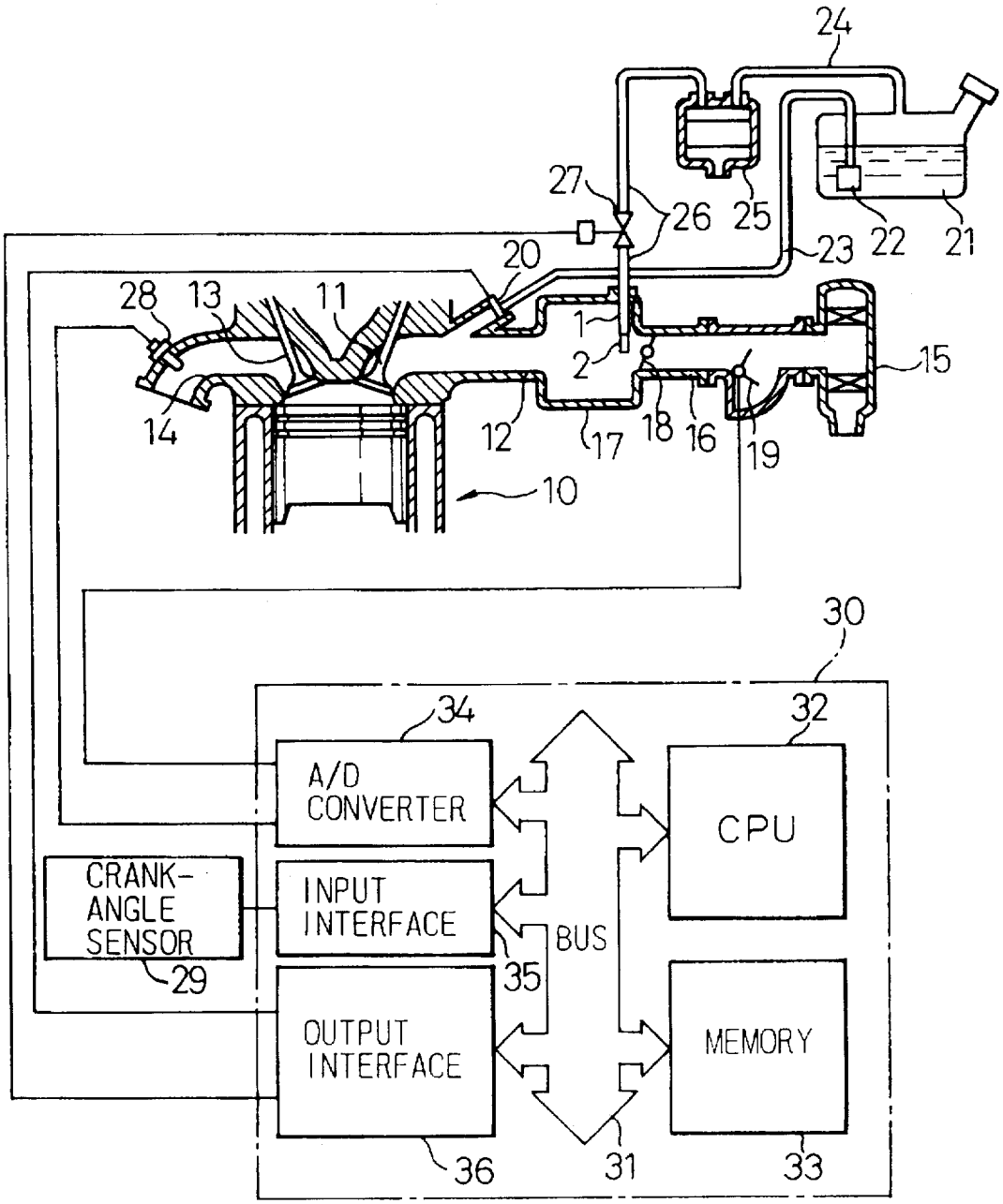
FIG. 1 shows an apparatus for processing evaporated fuel according to an embodiment of the present invention.

FIG. 1 shows an apparatus for processing evaporated fuel produced in a fuel tank for a multicylinder internal combustion engine according to the present invention. Each cylinder 10 has an intake valve 11 connected to an intake manifold 12, and an exhaust valve 13 connected to an exhaust manifold 14.

An air cleaner 15 filters air, which then passes through an intake duct 16, a surge tank 17, and the intake manifold 12 and is drawn into any cylinder 10 whose intake valve 11 is open. The intake duct 16 has a throttle valve 18 that controls the quantity of intake air. An airflow meter 19 measures the quantity of intake air.

A fuel injector 20 receives fuel from a fuel tank 21, which incorporates a fuel pump 22. The fuel pump 22 pressurizes the fuel and supplies it to the fuel injector 20 through a fuel pipe 23. The fuel tank 21 produces evaporated fuel, which is passed through an evaporated fuel pipe 24 to a canister 25. The canister 25 is connected to a purge pipe 26, which is connected to the surge tank 17. The purge pipe 26 has a purge control valve 27 whose duty-cycle is periodically controlled to open and close the valve 27 in general.

The exhaust manifold 14 has an air-fuel-ratio sensor 28 for detecting the air-fuel ratio of exhaust gas. A crank-angle sensor 29 detects a crank angle, which is used to calculate an engine speed and determine fuel injection and ignition timing.

An electronic controller 30 controls the purge control valve 27 according to the quantity of intake air, to purge fuel accumulated in the canister 25 into the surge tank 17. The electronic controller 30 may be a microcomputer having a CPU 32, a memory 33, an A/D converter 34, an input interface 35, and an output interface 36. These components are connected to one another through a bidirectional bus 31.

The airflow meter 19 provides the quantity of intake air to the electronic controller 30 through the A/D converter 34. The air-fuel-ratio sensor 28 provides the air-fuel ratio of exhaust gas to the electronic controller 30 through the A/D converter 34. The crank-angle sensor 29 provides a crank angle to the electronic controller 30 through the input interface 35. The electronic controller 30 is connected to the fuel injector 20 and purge control valve 27 through the output interface 36.

Evaporated fuel produced in the fuel tank 21 is adsorbed by an adsorbent, such as activated carbon, contained in the canister 25. The purge control valve 27 is intermittently opened during the operation of the engine. At this time, a negative pressure in the surge tank 17 and intake manifold 12 on the downstream side of the throttle valve 18 draws the adsorbed fuel from the canister 25 into the surge tank 17 through the purge pipe 26. This fuel is mixed with fuel injected from the fuel injector 20, and the mixture is burned in the cylinder 10. To maintain a purity level of the exhaust gas, the air-fuel-ratio sensor 28 detects the air-fuel ratio of exhaust gas, and the electronic controller 30 controls, accordingly, the opening time of the fuel injector 20 to attain a theoretical air-fuel ratio that provides the cleanest exhaust level. The opening time of the fuel injector 20 is corrected by reducing a time corresponding to the quantity of purged fuel from the canister 25. If the purged fuel is not evenly distributed to each cylinder of the engine, the cylinders may generate different combustion torque to deteriorate drivability and emit unburned fuel. The first to sixth embodiments to evenly distribute the purged fuel to each cylinder will be explained.

Each of the first to fourth embodiments branches the purge pipe 26 into two on the downstream side of the purge control valve 27 and connects the branches to the surge tank 17. Each of the fifth and sixth embodiments connects the purge pipe 26 to the surge tank 17 so that purged fuel from the purge pipe 26 may swirl due to the intake air. The embodiments will be explained in detail with reference to FIGS. 1 to 8. The left part of each of FIGS. 2 to 8 shows the surge tank 17 seen from a downstream side, and the right part thereof shows a longitudinal section of the same.

Figure 2:
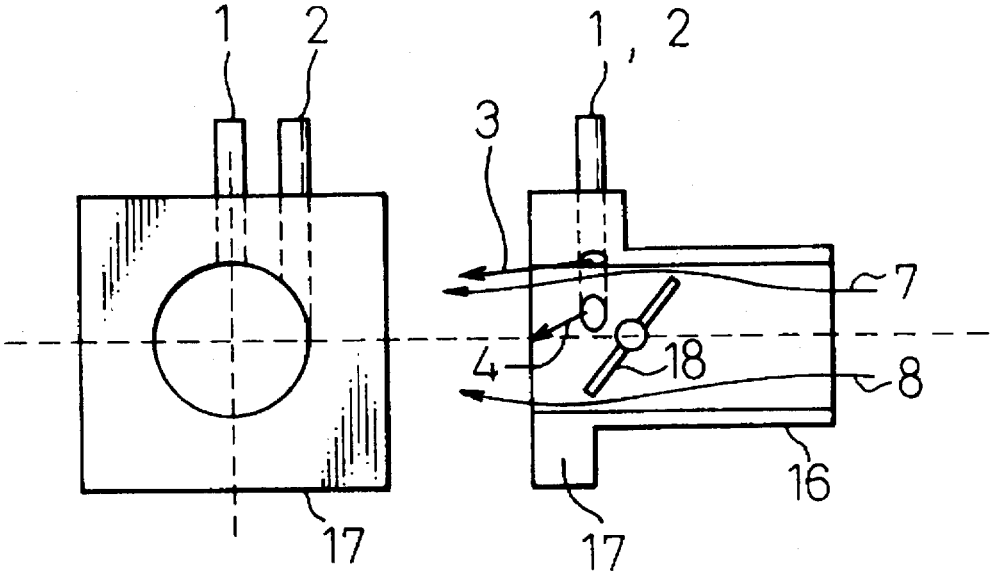
FIG. 2 shows a purge pipe according to a first embodiment of the present invention.

FIG. 2 shows a purge pipe 26 according to the first embodiment. The purge pipe 26 is branched into two on the downstream side of the purge control valve 27, and the branches are connected to the surge tank 17. One of the branches has a first purge port 1, and the other has a second purge port 2. Both the purge ports are open in the surge tank 17. Purged fuel from the canister 25 flows into the surge tank 17 through the purge ports 1 and 2. When the throttle valve 18 is opened, intake air flows from the intake duct 16 into the surge tank 17 through the throttle valve 18. The intake air carries the purged fuel toward the intake valve 11, and the intake air and purged fuel are mixed with fuel injected from the fuel injector 20. The mixture is drawn into the cylinder 10.

There are fast and slow intake air flows around the throttle valve 18. When the throttle valve 18 is opened, an upper bore of the throttle valve 18 forms a fast intake air flow 7, and a lower bore thereof forms a fast intake air flow 8. A slow intake air flow is produced around the rotation axis of the throttle valve 18. The first purge port 1 is open to the fast intake air flow 7, to provide a fast purged fuel flow 3. The second purge port 2 is open to the slow intake air flow, to provide a slow purged fuel flow 4. The purge ports 1 and 2 are arranged on the same sectional plane of the surge tank 17. The purged fuel from the purge ports 1 and 2 is carried and sufficiently agitated by the fast and slow intake air flows and is evenly distributed to each cylinder. The purge ports 1 and 2 may be arranged on the upstream side of the throttle valve 18 with the first purge port 1 being open to a fast intake air flow and the second purge port 2 to a slow intake air flow.

Figure 3:
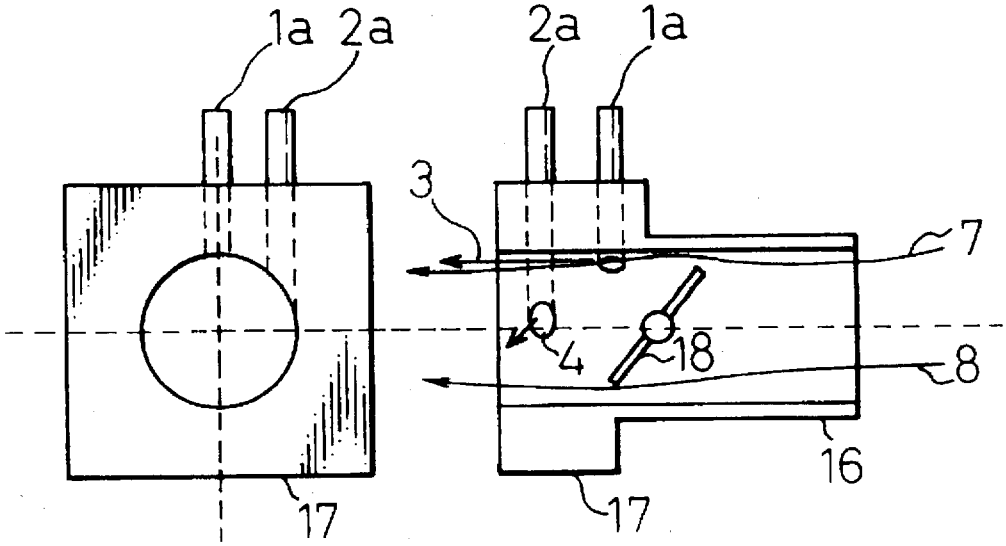
FIG. 3 shows a purge pipe according to a second embodiment of the present invention.

FIG. 3 shows a purge pipe 26 according to the second embodiment. The purge pipe 26 has, in the surge tank 17, a first purge port 1*a* that is open to a fast intake air flow and a second purge port 2*a* that is open to a slow intake air flow. The purge ports 1*a* and 2*a* are arranged on different sectional planes of the surge tank 17. The other parts of the second embodiment are the same as those of the first embodiment.

Figure 4:
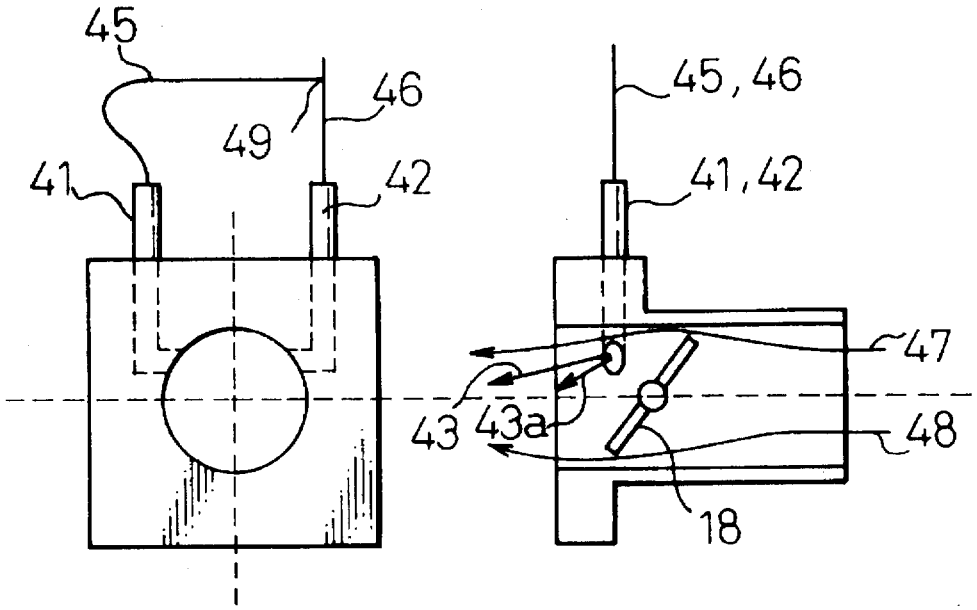
FIG. 4 shows a purge pipe according to a third embodiment of the present invention.

FIG. 4 shows a purge pipe 26 according to the third embodiment. This embodiment employs means for adjusting a flow time. The purge pipe 26 is branched into two at a branching point 49 on the downstream side of the purge control valve 27. One of the branches has a first hose 45 extending from the branching point 49 to a first purge port 41 that is open in the surge tank 17. The other branch has a second hose 46 extending from the branching point 49 to a second purge port 42 that is open in the surge tank 17. The first hose 45 is longer than the second hose 46, and therefore, a flow time of purged fuel passing through the first hose 45 is longer than a flow time of purged fuel passing through the second hose 46. Accordingly, purged fuel substantially continuously flows into the surge tank 17, although the purge control valve 27 is periodically opened and closed. The purge ports 41 and 42 are open to a fast intake air flow 47 passing through the upper bore of the throttle valve 18, or to a fast intake air flow 48 passing through the lower bore of the throttle valve 18, to produce fast purged fuel flows 43 and 43*a* that are properly agitated in the surge tank 17. The purged fuel flows are continuous and are evenly distributed to each cylinder.

Figure 5:
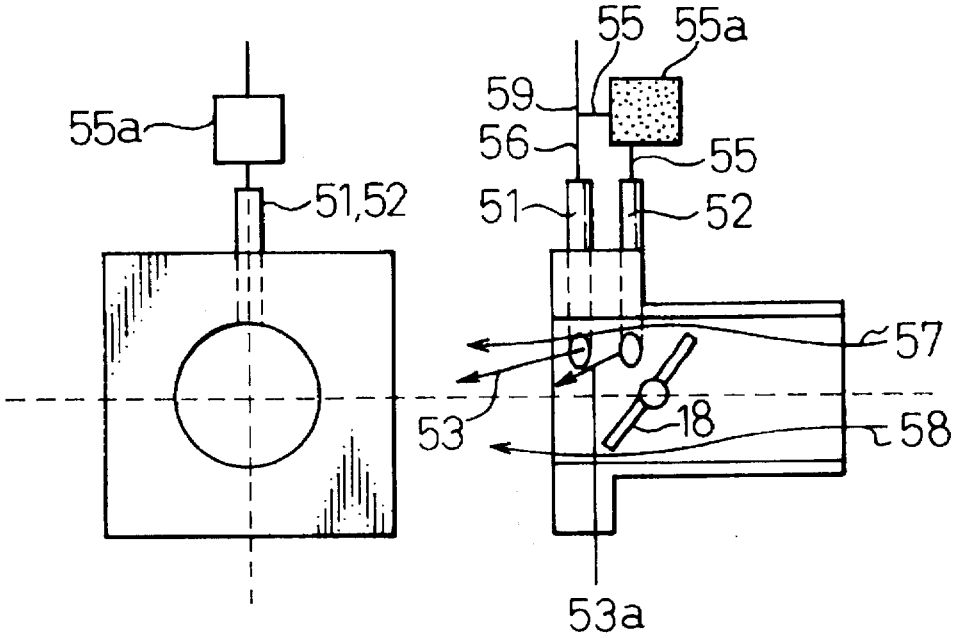
FIG. 5 shows a purge pipe according to a fourth embodiment of the present invention.

FIG. 5 shows a purge pipe 26 according to the fourth embodiment. Similar to the third embodiment of FIG. 4, the fourth embodiment employs means for adjusting a flow time. The same parts as those of FIG. 4 are represented each with a like numeral plus 10. The fourth embodiment is characterized by a tank 55*a*. Instead of extending a first hose 55, the tank 55*a* is arranged in the first hose 55. The tank 55*a* prevents pulsations in a flow of purged fuel that is intermittently supplied to the tank 55*a*, thereby smoothing and changing the velocity of the purged fuel.

Figure 6:
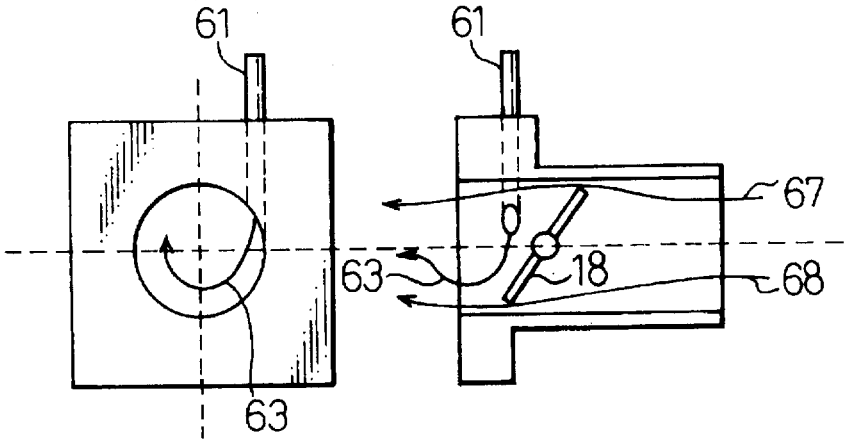
FIG. 6 shows a purge pipe according to a fifth embodiment of the present invention.

FIG. 6 shows a purge pipe 26 according to the fifth embodiment. This embodiment generates a swirl of purged fuel in the surge tank 17. The purge pipe 26 has a purge port 61 that is open in the surge tank 17. The opening of the purge port 61 is tangential to the bore of the surge tank 17, to twist the flow of purged fuel with respect to an intake air flow in the surge tank 17. The purge port 61 is open to a slow intake air flow, to easily form a swirl 63 of purged fuel. Namely, the opening of the purge port 61 is away from a fast intake air flow 67 passing through the upper bore of the throttle valve 18 and from a fast intake air flow 68 passing through the lower bore of the throttle valve 18. The swirling purged fuel and intake air advance toward the intake valve 11 and are mixed with fuel injected from the fuel injector 20. The mixture is drawn into the cylinder 10.

Figure 7:
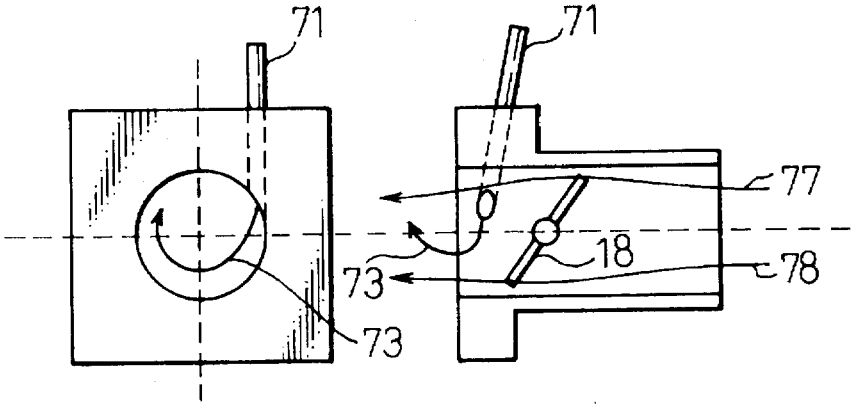
FIG. 7 shows a purge pipe according to a modification of the fifth embodiment.

FIG. 7 shows a purge pipe 26 according to a modification of the fifth embodiment. The modification generates a swirl of purged fuel in the surge tank 17, similar to the fifth embodiment of FIG. 6. The same parts as those of the fifth embodiment are represented each with a like numeral plus 10. The modification is characterized in that the purge pipe 26 is inclined such that a purge port 71 of the purge pipe 26 is downstream from a part thereof that is in contact with the periphery of the surge tank 17. As a result, purged fuel flows into the surge tank 17 from the upstream side toward the downstream side thereof, to more easily form a swirl.

Figure 8:
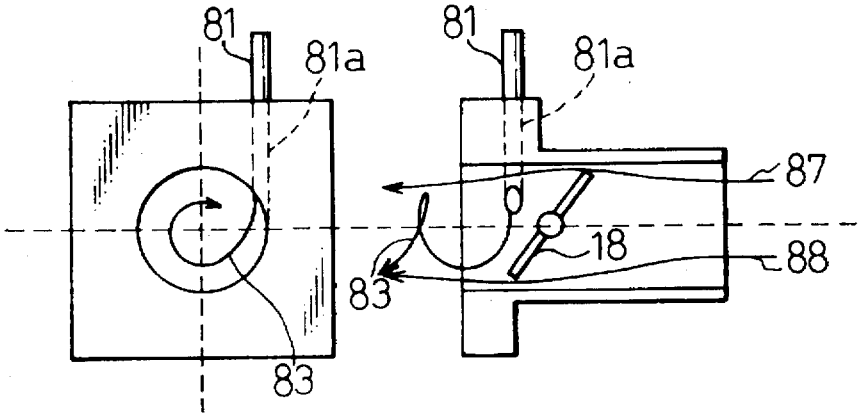
FIG. 8 shows a purge pipe according to a sixth embodiment of the present invention.

FIG. 8 shows a purge pipe 26 according to the sixth embodiment. This embodiment generates a swirl of purged fuel in the surge tank 17, similar to the fifth embodiment of FIG. 6. The same parts as those of FIG. 6 are represented each with a like numeral plus 20. The sixth embodiment is characterized in that a purge port 81 of the purge pipe 26 has a restrictor 81*a* for restricting a flow of purged fuel. This structure improves the velocity of the purged fuel, which is intermittently supplied, to easily produce a swirl thereof.

As explained above, the present invention branches a purge pipe into two on the downstream side of a purge control valve. Purge ports of the two branches are open to fast and slow intake air flows in a surge tank, to properly agitate the purged fuel. Alternatively, the present invention arranges, in a purge pipe, means for adjusting a flow time of purged fuel, to form a continuous flow of purged fuel that is intermittently supplied. Instead, the present invention connects an unbranched purge pipe to a surge tank and arranges a purge port of the purge pipe to produce a swirl of purged fuel. Any one of these arrangements of the present invention evenly distributes purged fuel to each cylinder, equalizes the combustion torque of each cylinder, improves drivability, and reduces an emission of unburned fuel.

What is claimed is:

1. An apparatus for processing evaporated fuel produced in a fuel tank for an internal combustion engine, having a canister for adsorbing the evaporated fuel and a purge passage for connecting the canister to an intake duct and purging the adsorbed fuel into the intake duct, said apparatus comprising:

an air intake portion of the intake duct;

a surge tank; and a throttle valve located in the intake duct between the air intake portion and the surge tank;

wherein air flows through the intake duct from the air intake portion through the throttle valve into the surge tank when the throttle valve is open, the open throttle valve resulting in air flow having different velocities at different positions in the intake duct, and the purge passage has purge ports that open into the intake duct at said different positions introducing the purged adsorbed fuel into said different velocities of intake air.

2. The apparatus of claim 1, wherein the purge ports have openings on the same sectional plane of the intake duct and consist of a first purge port that is open to fast intake air in the intake duct and a second purge port that is open to slow intake air in the intake duct.

3. An apparatus for processing evaporated fuel produced in a fuel tank for an internal combustion engine, having a canister for adsorbing the evaporated fuel and a purge passage for connecting the canister to an intake duct and purging the adsorbed fuel into the intake duct, the apparatus comprising:

an air intake portion of the intake duct;

a surge tank; and a throttle valve located in the intake duct between the air intake portion and the surge tank;

wherein air flows through the intake duct from the air intake portion through the throttle valve into the surge tank when the throttle valve is open, the open throttle valve resulting in air flow having different velocities through the intake duct at different positions in the intake duct, and the purge passage has branches and means for providing different flow times to purged fuel passing through the branches prior to the purged fuel being introduced into the intake duct, said purge passage having purge ports that open into the intake duct at said different positions introducing the absorbed fuel from the canister into the intake duct.

4. The apparatus of claim 3, wherein the means for providing different flow times is a tank arranged in the purge passage.

5. An apparatus for processing evaporated fuel produced in a fuel tank for an internal combustion engine, having a canister for adsorbing the evaporated fuel and a purge passage for connecting the canister to an intake duct and purging the adsorbed fuel into the intake duct, the apparatus comprising:

an air intake portion of the intake duct;

a surge tank; and a throttle valve located in the intake duct between the air intake portion and the surge tank;

wherein air flows through the intake duct from the air intake portion through the throttle valve into the surge tank when the throttle valve is open, the air flow being faster as it passes a first portion of the valve and the air flow being slower as the air passes a second portion of the valve, and the purge passage has a purge port opening tangentially into the intake duct and introducing the purged adsorbed fuel into the flow of slower air.

6. The apparatus of claim 5, wherein the purge port further comprises a means for restricting a flow of purged fuel.

* * * * *